US005211402A

United States Patent [19]

Ferguson et al.

[11] Patent Number: 5,211,402

[45] Date of Patent: May 18, 1993

[54] ANALOGIES BOARD GAME

[76] Inventors: James A. Ferguson; Becky J. Ferguson, both of Box 286, Chicora, Pa. 16025

[21] Appl. No.: 935,556

[22] Filed: Aug. 26, 1992

[51] Int. Cl.[5] ..... A63F 3/00; A63F 9/18

[52] U.S. Cl. ..... 273/249; 273/341

[58] Field of Search ..... 273/249, 248, 246, 243, 273/250–254, 256, 237, 429–432

[56] References Cited

U.S. PATENT DOCUMENTS

| | | | |
|---|---|---|---|
| 4,363,628 | 12/1982 | Kirkpatrick et al. | 273/256 |
| 4,624,463 | 11/1986 | Glennon | 273/246 |
| 4,807,878 | 2/1989 | Tripp | 273/237 |
| 5,066,016 | 11/1991 | O'Neill | 273/249 |

FOREIGN PATENT DOCUMENTS

| | | | |
|---|---|---|---|
| 2200291 | 8/1988 | United Kingdom | 273/249 |

OTHER PUBLICATIONS

Barron's How to Prepare for College Entrance Examinations, by Samuel C. Brownstein and Mitchel Weiner, 1962, pp. 108–112.

*Primary Examiner*—Benjamin H. Layno

*Attorney, Agent, or Firm*—George C. Atwell

[57] ABSTRACT

A board game apparatus is provided for expanding the players' vocabulary and increasing their knowledge and wisdom of the world by correctly responding to relationships by drawing analogies between people, events, places, things, and concepts. The analogy board game includes a game board having a central main walkway and eight subject major walkways arranged about and connected to the main walkway. Each subject major walkway denotes one respective subject major. The relationships and responses are contained in eight respective analogy relationship and response books, with each book containing three levels of relationships and responses for one particular subject major, and the subject major of each book corresponds to the subject major of each subject major walkway. Players traverse the game board, entering each subject major walkway and collecting pass cards after they have correctly answered all questions while traversing the subject major walkways. Player token travel is in any direction on the game board. After each player completes all subject major walkways and passes a final exam question related to the subject major walkway from which the player started, the players move their tokens to a graduation stage where a correct roll of the dice determines the winner.

13 Claims, 5 Drawing Sheets

ANALOGIES BOARD GAME

BACKGROUND OF THE INVENTION

The present invention relates to board games, and more particularly pertains to a board game which expands one's vocabulary and increases one's knowledge and wisdom of the world by choosing the correct analogy to words denoting people, events, places, things, and concepts.

Despite the advent of the home computer and electronic games, of which Nintendo is the current favorite, board games retain their appeal and show no signs of falling into obsolescence as have other forms of once popular entertainment, such as the drive-in movie theater. Board games pleasurably combine qualities of life in general—calculated risk taking, weighing and evaluating the odds that an outcome will or will not transpire, formulating strategies to meet a variety of future occurrences, and the indeterminancy involved with a lucky roll of the dice—in the miniaturized setting of the board game. Depending on the board game chosen, the players can target and sink an opponent's battleship, amass and manipulate real estate holdings, as in the classic Monopoly board game (U.S. Pat. No. 2,026,082), traverse medieval landscapes evading the dangers and mysteries lurking therein, or answer questions, both trivial and profound, drawn from every aspect of human experience and knowledge, as in the game Trivial Pursuit. Indeed, the number and type of board games is limited only by the scope of human ingenuity.

The prior art reveals a number of board games having varying objectives, modes of play and goals. U.S. Pat. No. 4,065,131 (Martin, Jr. et al.) discloses a board game in which players traverse a game board, each traverse around the board corresponding to one college semester, with the goal being to graduate with the highest GPA (grade point average).

U.S. Pat. No. 4,273,337 (Carrera et al.) discloses a board game in which players traverse the board, randomly landing on spaces and answering questions contained in the separate card decks, representing three levels of questions, relating to the area of human sexuality.

U.S. Pat. No. 4,557,485 (Lardon) discloses a board game wherein players traverse a game track color coded to match three marked and correspondingly colored cards. After accumulating 1,500 points, the player advances to an end-of-game compartment centrally located on the game board.

U.S. Pat. No. 4,640,513 (Montijo) discloses a game board wherein players attempt to successfully complete a variety of challenges, such as spelling, pronouncing, and defining words correctly, remembering number sequences, and answering question cards. Players move around the board to a winner's circle.

U.S. Pat. No. 4,714,254 (Calloway) discloses an educational-type game having two sets of questions and answer cards that represent lessons and tests for the players. Players advance their playing pieces on the inner playing spaces by correctly answering test questions.

U.S. Pat. No. 4,714,255 (Henry et al.) discloses a question and answer board game relating to the field of criminal justice. Players move around the board on either of two playing tracks by answering questions arranged in three levels of difficulty.

Despite the ingenuity and the pleasurable effects derived from playing the above-mentioned board games, there remains a need for a board game which develops and expands one's vocabulary, increases one's knowledge of the world, and challenges the application of that knowledge and wisdom in a friendly and enjoyable manner.

SUMMARY OF THE INVENTION

The present invention comprehends a board game apparatus whereby a plurality of players attempt to correctly determine the relationships between comparative items by making and drawing analogies regarding people, places, events, things, and concepts.

The board game apparatus of the present invention includes a game board adapted for flat disposition on a level surface and for foldable disposition for storage and transportation in a carrying, or attache, case. The board game has arranged thereon a centrally-located, rectangular-shaped main walkway and eight rectangular-shaped subject major walkways arranged about the main walkway and connected thereto by connecting squares. The main walkway, the subject major walkways, and the connecting squares form a continuous path on the game board for the playing tokens to traverse. Each subject major walkway denotes one respective subject major.

The relationships and correct responses for each subject major are contained in eight respective analogy relationship and response books, with each book containing relationships and responses pertaining to one particular subject major. The relationships and responses contained in each book are arranged in an ascending order of levels, with Level I relationships being the easiest, Level II relationships being of intermediate difficulty, and Level III relationships being the most difficult to answer.

The players start their playing tokens at the entranceway of each respective subject major walkway, and the playing tokens can move in any direction on the main walkway, but only in one direction when traversing each respective subject major walkway. Each player must successfully traverse all eight subject major walkways although the order is up to the individual player (or players if there are two-person teams playing the game). In order to successfully traverse each subject major walkway, each player must correctly choose the proper relationship from the analogy book whose subject major corresponds to the particular subject major walkway.

The level of the analogy relationship to be determined and the number of spaces the players can move their tokens on the game board are determined by a pair of dice, one of which is a regular six-sided die and the other die, the analogy level die, having indicia marked thereon representing the three levels of analogy relationships, specifically Level I, Level II, and Level III.

In order to successfully traverse all the subject major walkways, the players in their turn roll the dice and attempt to choose the correct relationship from the analogy book corresponding to the particular subject major walkway each player is traversing. The analogy level die determines the level of the relationship the player must correctly answer. A correct answer permits the player to move the number shown on the regular die plus the level of the correctly chosen relationship. An incorrect response causes the player to lose his or her turn. As each subject major walkway is successfully traversed the players collect pass cards corresponding to the respective subject major walkways and which signify that the players have successfully chosen the proper analogies pertaining to all the subject major walkways. After a player collects eight pass cards, one for each subject major walkway, the player returns to the entrance space for the subject major walkway at which he began. In order to be eligible for graduation, the player must pass a final exam which consists of responding to one Level III analogy correctly. When the proper response is given, the player moves to the graduation stage for the graduation phase of the board game which determines the winner (which player graduates first).

The board game apparatus includes a graduation stage which may be a square- or rectangular-shaped structure sized to fit within the main walkway on the game board. The graduation stage includes graduation spaces having indicia marked thereon representing each number on the regular six-sided die and the three levels on the analogy die. In addition, the present invention includes a graduation roll card holder which contains two sets of cards: a first set of graduation roll cards has indicia marked thereon representing the three analogy levels and a second set of graduation roll cards includes six cards having indicia marked thereon representing each number on the regular die. A combination from these two sets of cards is predetermined before play and placed face up in the graduation card holder. After the first player passes his final exam, the graduation roll card holder is opened to ascertain the graduation requirements, i.e., the correct combination of regular die and analogy level die that must be rolled for one of the players to be determined the winner.

It is an objective of the present invention to provide entertainment and education for the players in a friendly and competitive manner.

Another objective of the present invention is to enhance the players' knowledge and wisdom and augment their vocabulary by playing the board game.

Still another objective of the present invention is to enhance the player's knowledge and wisdom of relationships between words, concepts, and ideas.

These and other objects of the invention will become apparent from the following detailed description of the invention, from the attached drawings, and from the appended claims.

DETAILED DESCRIPTION OF THE PREFERRED EMBODIMENT

Referring now to FIGS. 1–12 there is shown a board game apparatus 10 embodying the present invention and designated by the name "Analogies". The game 10 combines both skill and chance and is designed to be both educational and entertaining. A number of players, either playing individually or in teams composed of two players, are required to correctly respond to relationships by making or drawing analogies. On each player's turn, two words which are related to each other in terms of purpose, function, goal, etc., and which denote people, places, events, things, or concepts, are provided as hints or suggestions. In addition, another word is given to the player(s) and they must choose the correct analogy for that word from a list of four different words having varying degrees of similarity to each other and to the given word. However, only one word from the list is the correct analogy to the given word.

Because the game 10 has an academic element as well as an entertainment element, the playing tokens and pieces, the layout of the game board, and the structure and rules of the game 10 itself borrow terminology and features from the university or academic world. The game board and the various playing pieces will be described first, followed by a description of the rules and manner of play of the game 10.

Figure 1:
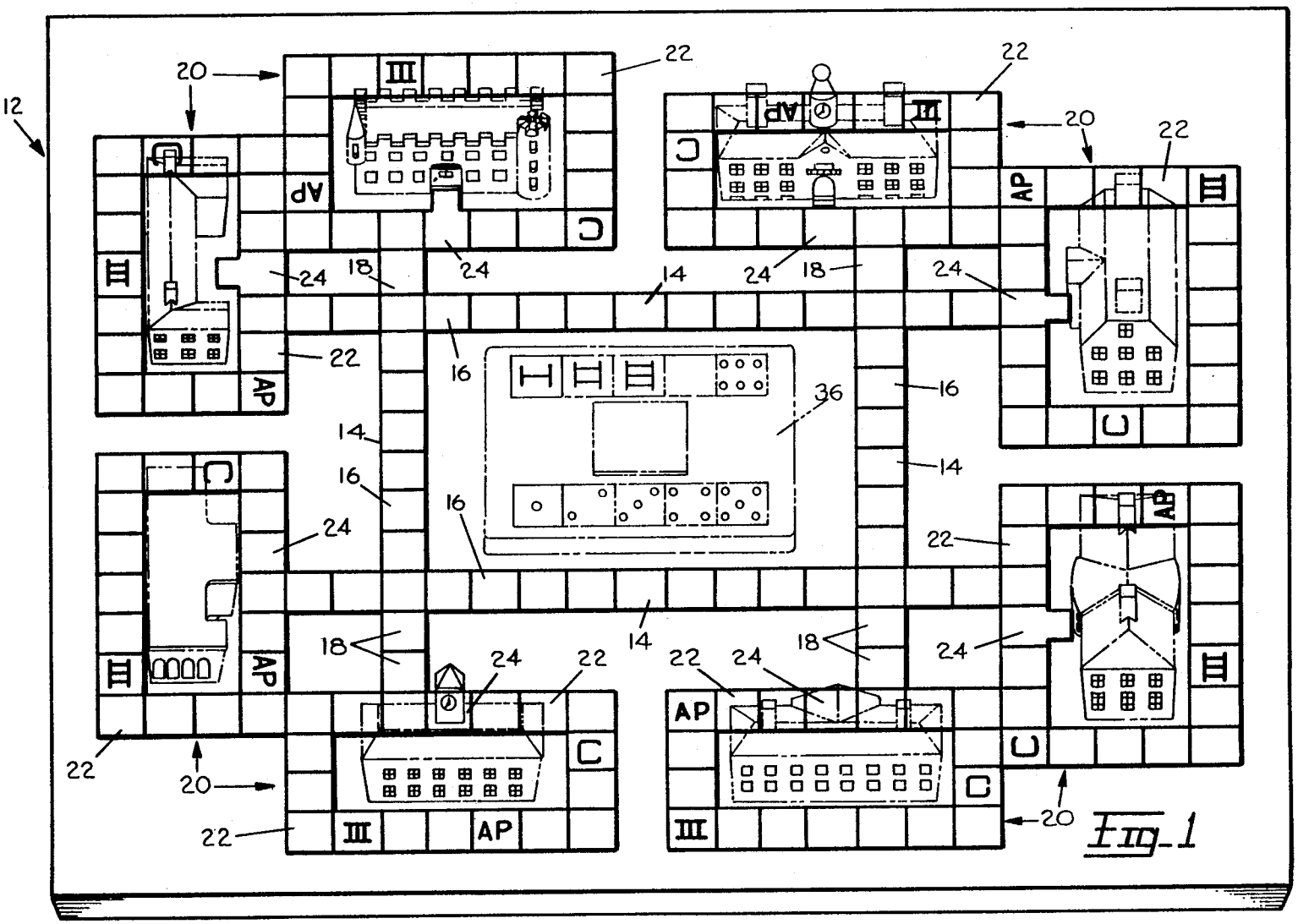
FIG. 1 is a top plan view of the board game apparatus of the present invention.

Referring to FIG. 1, a game board 12 is shown disposed in its flat, opened, use or playing position. The dimensions of the board 12 can vary depending upon packaging and marketing requirements, but a preferred size is 24"×24". The board 12 can be constructed from a firm single- or multi-ply cardboard or laminated plastic material with a crease or flexible joint extending through the middle of the board 12 to allow it to be opened for a selective flat disposition on a level playing surface and also for a foldable disposition to allow for storage or carrying to other playing sites. The board 12 may be entirely covered with a felt cloth, preferably green in color, and may have magnetized sheets or strips underneath the cloth for maintaining the playing tokens upon the board 12 during play thereof.

Located on the board 12 are various walkways or pathways that the playing tokens traverse during play. Centrally located on the board 12 and having either a square or rectangular shape is a continuous main walkway 14. The walkway 14 is characterized by a plurality of continuously connected main walkway spaces 16. Extending laterally and outwardly from the walkway 14, at right angles thereto, are a plurality of connecting squares 18. The squares 18 are contiguously joined to the spaces 16 and form the corners of the walkway 14. Arranged on the board 12 and located adjacent and about the walkway 14 are a plurality of subject major walkways 20. The board 12 employs eight walkways 20 corresponding to and representing eight general fields of knowledge, or subject majors, with each walkway 20 corresponding to one subject major in particular. The subject majors themselves are drawn from general courses found in any undergraduate university or college curriculum.

Each walkway 20 includes a plurality of continuously connected subject spaces 22, one of which is the entranceway to each walkway 20, and, as shown in FIG. 1, each walkway 20 forms a smaller, generally rectangular-shaped figure on the board 12. In addition, each walkway 20 is connected to the main walkway 14 by the squares 18, one of which is contiguously joined to at least one space 22. Thus, the walkways 14 and 20, and the squares 18 form a continuous path on the board 12. Each walkway 20 includes at least one subject space 24 that is distinctively color-coded to denote the subject major represented by that particular walkway 20 and distinguish it from the subject majors of the other walkways 20.

Figure 4:
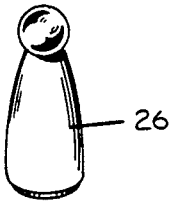
FIG. 4 is a perspective view of a respective playing token used with the board game apparatus of the present invention.

Illustrated in FIG. 4 is one of the plurality of colored playing tokens 26 for use with the board 12. In the game 10, eight tokens 26 are used, each representing one player or team of players. The particular color of each token 26 corresponds to the respective space 24. As shall be more fully described hereinafter, the tokens 26 are disposed on the board 12 for incremental movement on the walkways 14 and 20 and the squares 18. The bottom of the tokens 26 can be weighted with a cylindrical metal disk glued onto the wooden or plastic tokens 26 so as to maintain, by the force of magnetic attraction, each token 26 in its particular position on the board 12.

Figure 3:
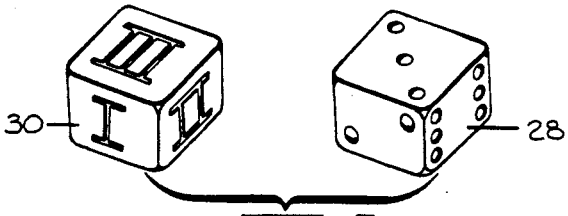
FIG. 3 is a perspective view of a pair of dice used to determine the range of movement by the players on the board game apparatus first shown in FIG. 1.

In order to determine the possible number of spaces 16, 18, and 22 and range or extent of movement each respective token 26 can move in its turn on the board 12, an incremental movement means must be utilized. In the game 10, the incremental movement means includes, as illustrated in FIG. 3, a pair of dice which consists of one six-sided regular numbered die 28 and one analogy level die 30. The die 30 has indicia marked on its respective sides corresponding to levels of analogies pertaining to each respective subject major. The die 28 determines the range of movement of each token 26 on the walkways 14 and 20 and the squares 18; and the die 30 determines the level of analogy question the player(s) must answer in their turn.

Figure 2:
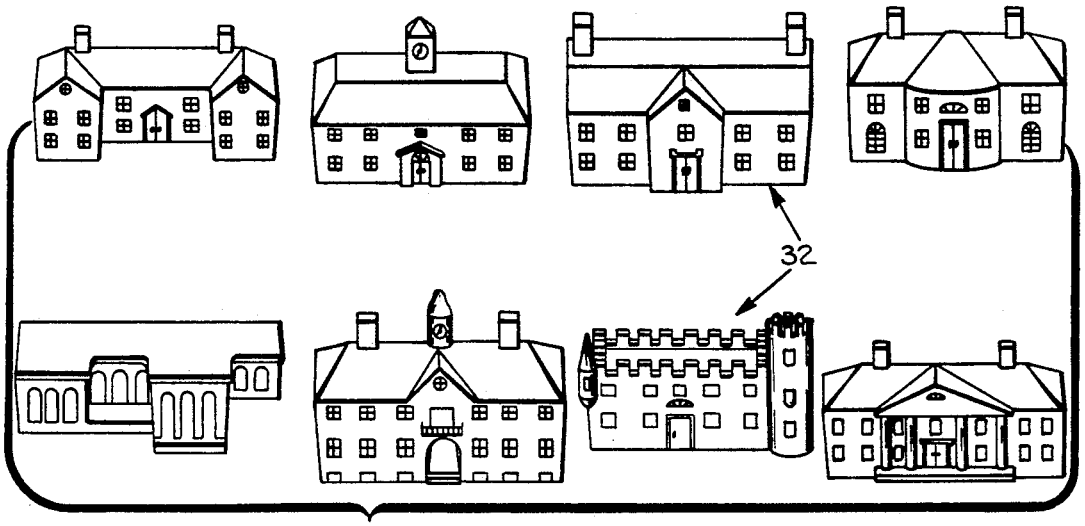
FIG. 2 is a perspective view of a plurality of building structures disposed on the board game apparatus first shown in FIG. 1.

Referring to FIG. 2, there are shown a plurality of building structures 32 which are disposed on the board 12 during play of the game 10. In the present invention, eight structures 32 are utilized, each having a distinctive and unique shape in order to distinguish them from one another. The structures 32 represent buildings on a typical college campus: i.e., cathedral, science center, administration complex, sports complex, etc. Each structure 32 represents one subject major and has a distinctively colored door which corresponds to one of the tokens 26. When the board 12 is set up for play each structure 32 is placed on the board 12 and within the corresponding walkway 20, as shown in FIG. 1. The structures 32 can be manufactured out of wood or a molded plastic material.

Figure 5:
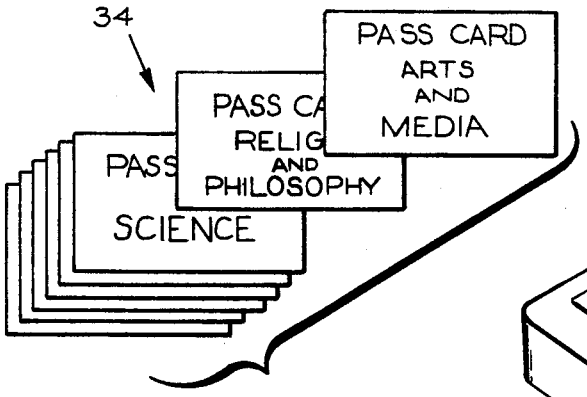
FIG. 5 is a front elevational view of a plurality of representative passcards from several of the plurality of passcard sets and which are used with the board game apparatus of the present invention.

Illustrated in FIG. 5 are a plurality of representative passcards 34 with distinctive indicia marked on their respective surfaces. The game 10 utilizes eight sets of passcards 34 with each set corresponding to one respective subject major. The visually discernible indicia of the three distinct passcards 34 shown in FIG. 5 denotes three of the eight respective subject majors. There are eight passcards 34 included in each of the eight passcard sets, and all of the passcards 34 for each respective set have the same indicia marked thereon for denoting the same subject major. In addition, each passcard set is distinctively colored to further distinguish the passcard sets from one another and is matched to the color of the corresponding token 26 and structure 32. The eight passcards 34 for each set also correspond to the maximum number of players for the game 10 and also to the eight walkways 20.

Figure 6:
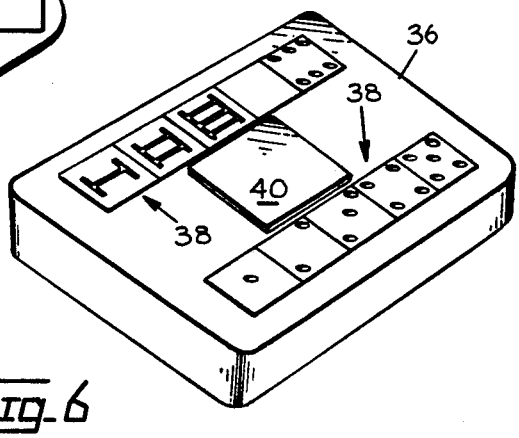
FIG. 6 is a perspective view of a graduation stage used with the board game apparatus first shown in FIG. 1.

Referring to FIG. 6, there is shown a graduation stage 36 for use with the game 10. The stage 36 can be a square- or rectangular-shaped platform constructed of wood or a plastic material and is disposed on the board 12 and within the walkway 14. The stage 36 further includes a plurality of graduation spaces 38 arranged thereon in two spaced-apart columns. The spaces 38 have unique indicia marked thereon corresponding to either the numbers on the die 28 or the analogy levels represented on the die 30. In addition, a central, square-shaped waiting space 40 separates the two columns of spaces 38.

Figure 8:
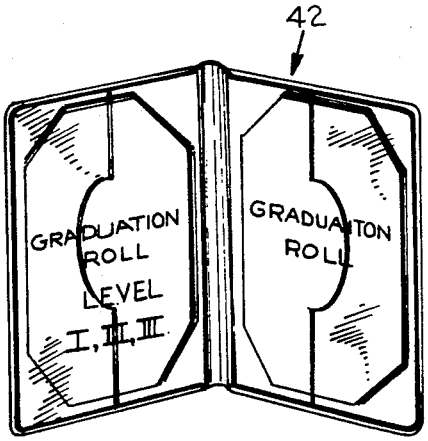
FIG. 8 is a perspective view of a graduation rollcard holder used with the board game apparatus first shown in FIG. 1.
Figure 9:
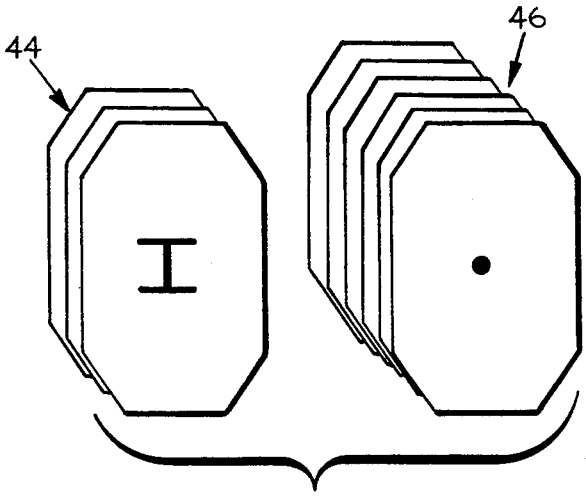
FIG. 9 is a front elevational view of two representative graduation rollcards which are disposed within the graduation rollcard holder first shown in FIG. 8.

FIG. 8 illustrates a graduation rollcard holder 42 used with the game 10. The holder 42 is preferably constructed from a flexible and foldable plastic material and, when opened, reveals two opposed clear plastic inside covers. Each clear plastic inside cover is attached along three of its edges to the edges of the holder 42 and has a fourth unattached inwardly opening edge for allowing material to be slidably disposed therein. In the game 10, the material which is slidably disposed within the inside covers of the holder 42 are a first set of graduation rollcards 44 and a second set of graduation rollcards 46. FIG. 9 illustrates one representative member of each of the two sets of rollcards 44 and 46. The rollcards 44, a representative member of which is the rollcard on the left side of FIG. 9, have unique indicia marked thereon, each denoting one level of questions and answers for the subject majors. More specifically, the three rollcards 44 are marked respectively with "I", "II", and "III" on the front sides. This corresponds to the Roman numerals marked on the die 30, as shown in FIG. 3, and the Roman numerals marked on the respective spaces 38 shown in FIG. 6. The six rollcards 46 each have indicia marked thereon corresponding to the range of numbers marked on the die 28. The right-hand card shown in FIG. 9 represents the rollcard 46 denoting the number one.

Figure 7:
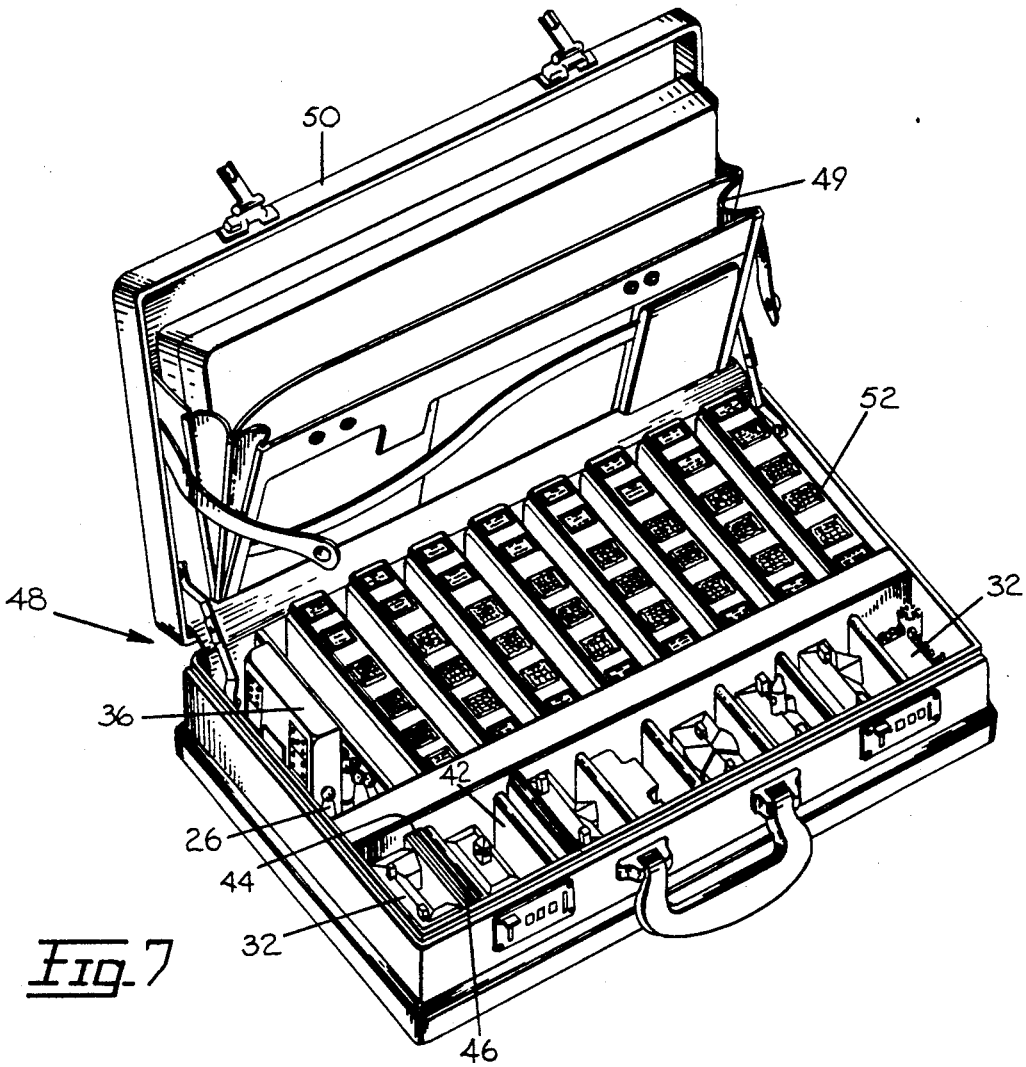
FIG. 7 is a perspective view of an attache case for storing the various playing pieces used with the board game apparatus first shown in FIG. 1.

In order to transport the game 10 from one playing location to another or to conveniently and quickly store the game 10 when not in use, an attache carrying case 48, as shown in FIG. 7, is utilized instead of a standard cardboard box. The case 48 may be preferably leather-covered and, when opened, discloses a number of storage compartments for containing the various playing pieces. The board 12 is folded and slidably disposed within a pouch 49 having two pairs of spaced-apart snaps located on its exterior surface. Attached at either long end of an attache cover 50 is an elongated strap having a fastener attached to its end. In order to secure the board 12 within the pouch 49, the straps are fastened to the snaps for tightly and securely enclosing the pouch 49. The bottom half of the case 48 is also divided into a number of separate compartments for storing therein the playing pieces of the present invention. Eight separate compartments are shown in the front of the case 48 wherein each respective structure 32 and its corresponding set of passcards 34 are stored. A compartment on the upper left-hand side stores the stage 36, the tokens 26, the dice 28 and 30, and the holder 42. The other large partition to the right stores the other necessary elements needed for the game 10.

The game 10 also includes a plurality of analogy books 52 containing the analogies and responses from which each player or team of players must choose and correctly respond in turn as they progress through the game. FIG. 7 shows the books 52 disposed within the case 48, with the spines of the books 52 facing upward. Each of the eight books 52 contains the three levels of analogies pertaining to one particular subject major. Thus, each book 52 corresponds with one of the eight sets of passcards 34, one of the eight tokens 26, one of the eight structures 32, and one of the eight walkways 20. The spines of the books 52 may have a gilt design for visual attractiveness; the cover of each book 52 may have a florid gilt design; and each book 52 has a colored strip at the top part of its spine which corresponds in color to the respective token 26, set of passcards 34, structure 32, and space 24 for each walkway 20. This color coding scheme ties together the various playing pieces and enhances the uniqueness of the game 10.

Depending on the size of the case 48 and the number of pages in each book 52, the number of analogies for each level can vary. Preferably, 200–400 analogies for each level are needed for variety and range of complexity and difficulty, and to avoid the possibility of analogies being repeated during the course of a single game. In the game 10, 300 analogies in each of the three levels appears to be the optimum number. Using 300 analogies in each level will require that each book 52 have 600 pages with the analogies on one page with the reverse page containing the responses. Each book 52 will thus contain a total of 900 analogies with 300 analogies in each of the three levels: I, II, and III. With eight books 52 being used, the total number of analogies will be 7,200 divided evenly into 2,400 analogies—and responses—for each of the three levels. This should insure that players will encounter original analogies during the play of a single game or during the play of several consecutive games before noticing the occasional repetition of a particular analogy or analogies.

The eight subject majors and their corresponding colors are as follows: geography—green; science—brown; health/physical education/sports—white; arts and media—yellow; English —purple; religion and philosophy—blue; history—gray; and business and math—red. The space 24, the passcards 34, the token 26, the structure 32, and the color stripe on the spine of the book 52 for each particular subject major are the same, and, consequently, a unique color coding scheme is achieved.

Figure 10:
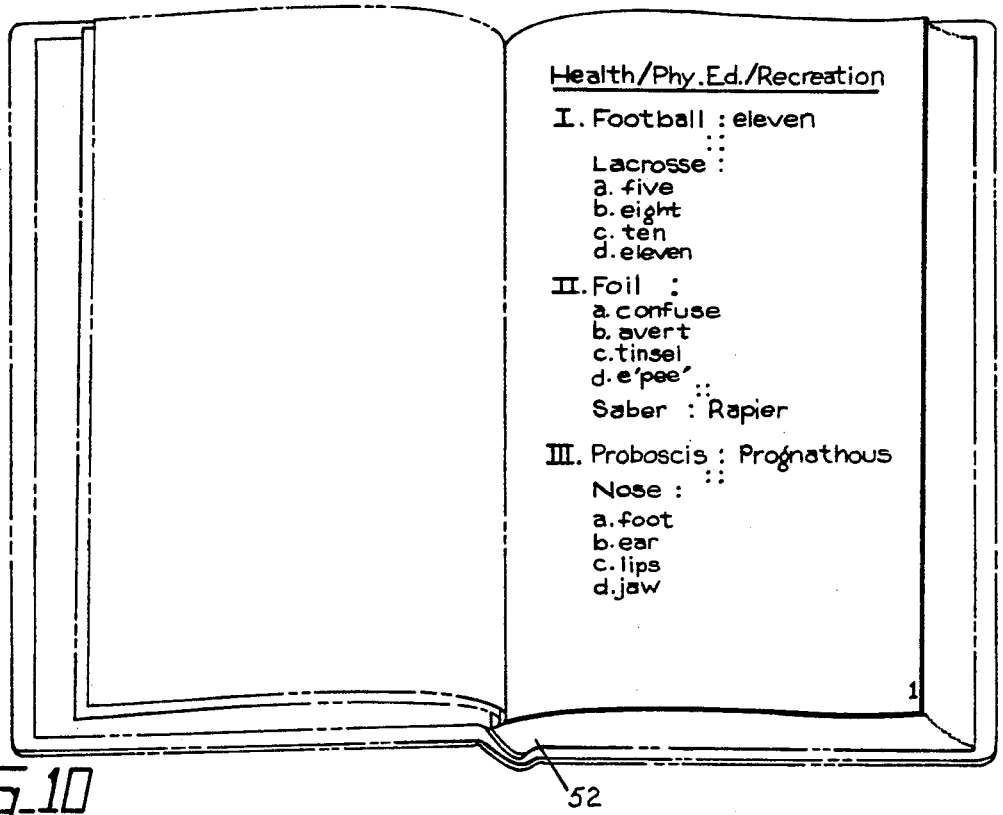
FIG. 10 is a top plan view of one of the eight analogy-response books, open to the first page containing the analogies, and which was first shown disposed in the attache case in FIG. 7.
Figure 11:
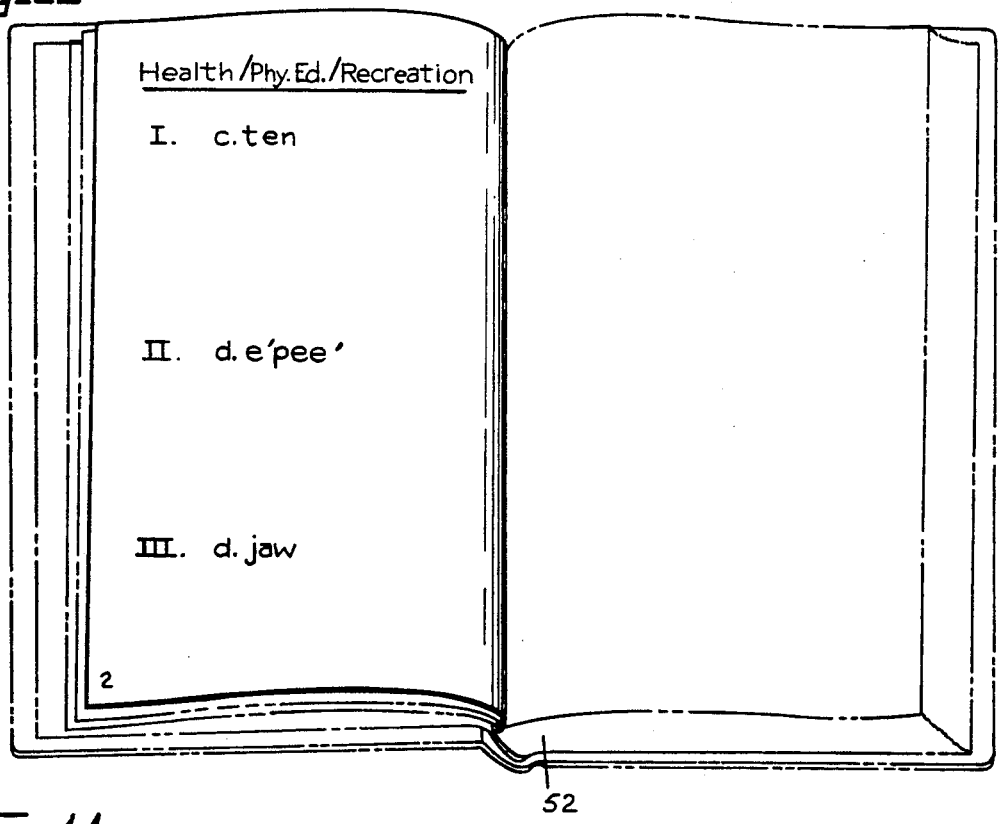
FIG. 11 is a top plan view of the analogy book open to Page 2 and which contains the responses to the analogies illustrated on Page 1 of the analogy book first shown in FIG. 10.

Referring to FIGS. 10–13, there are shown two of the books 52, open to their respective first and second pages to illustrate the layout of the analogies and responses. FIG. 10 shows the book 52 for the health, physical education, and recreation subject major, open to the first page with the three levels of analogies arranged thereon. Each analogy includes two words which denote people, objects, places, events, or things and which are analogous to each other. Immediately following, another word is given which also denotes either a person, place, thing, event, or concept and is itself analogous to the first word in the given analogous pair. Spaced in a column underneath this word are four choices, "a." through "d.", one of which is the correct analogy for the given word. FIG. 11 shows the reverse side of the page shown in FIG. 10. On this page, the correct response for each analogy is given. Referring to FIG. 10, the Level I analogy gives the suggestive hint "Football:eleven". Beneath this paired analogy is the word "Lacrosse:" and the player has four choices from which to pick the best analogy. In this example, an analogy is being drawn between a game and the number of players required for playing the game, so the correct response to the question is "c. ten" as Lacrosse is a game played by ten players. The Level II analogy gives the analogous pair "Saber:Rapier" which draws an analogy between two types of swords. Beneath this analogous pair is the word "Foil" to which the correct analogy is "D. e'pee". A foil and an e'pee are types of light fencing swords that have blunted ends. The Level III analogy on FIG. 10 gives the analogous pair "Proboscis:Prognathous" and underneath this analogous pair is the word "Nose". The correct analogy for "Nose", given the analogous pair "Proboscis: Prognathous" is "d. jaw". Proboscis and Prognathous are Greek terms for essentially nose and jaw.

Figure 12:
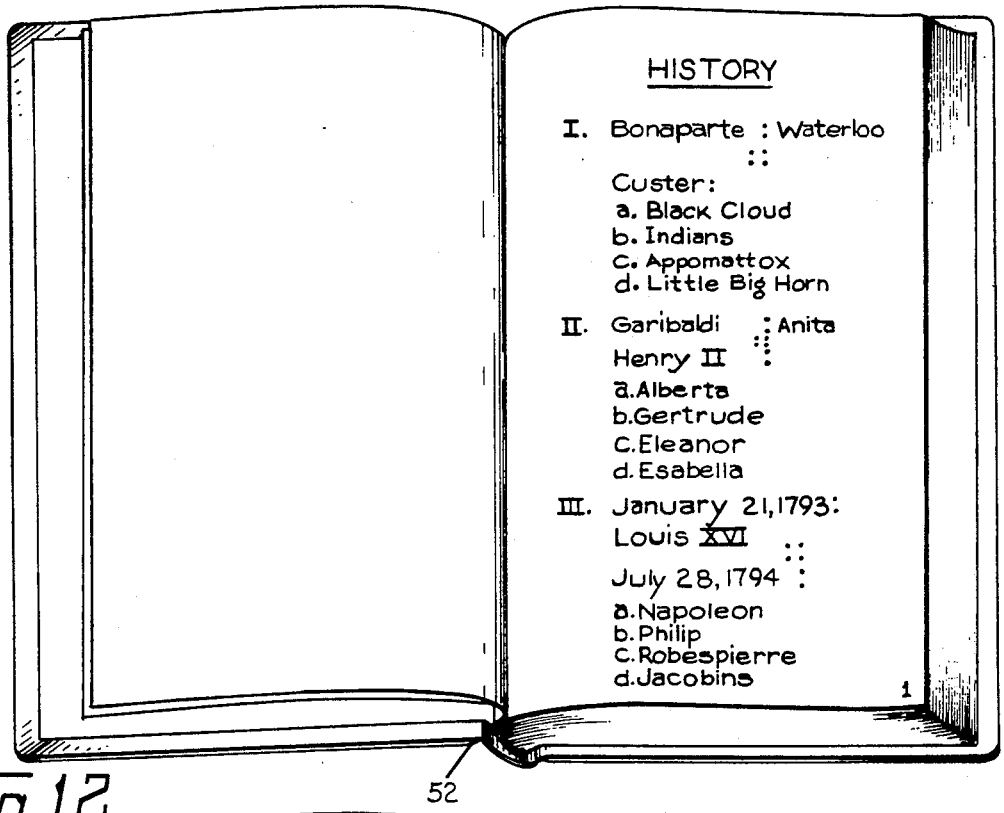
FIG. 12 is a top plan view of another analogy book first shown disposed in the attache case in FIG. 7 and which is open to the first page for illustrating representative analogy questions.
Figure 13:
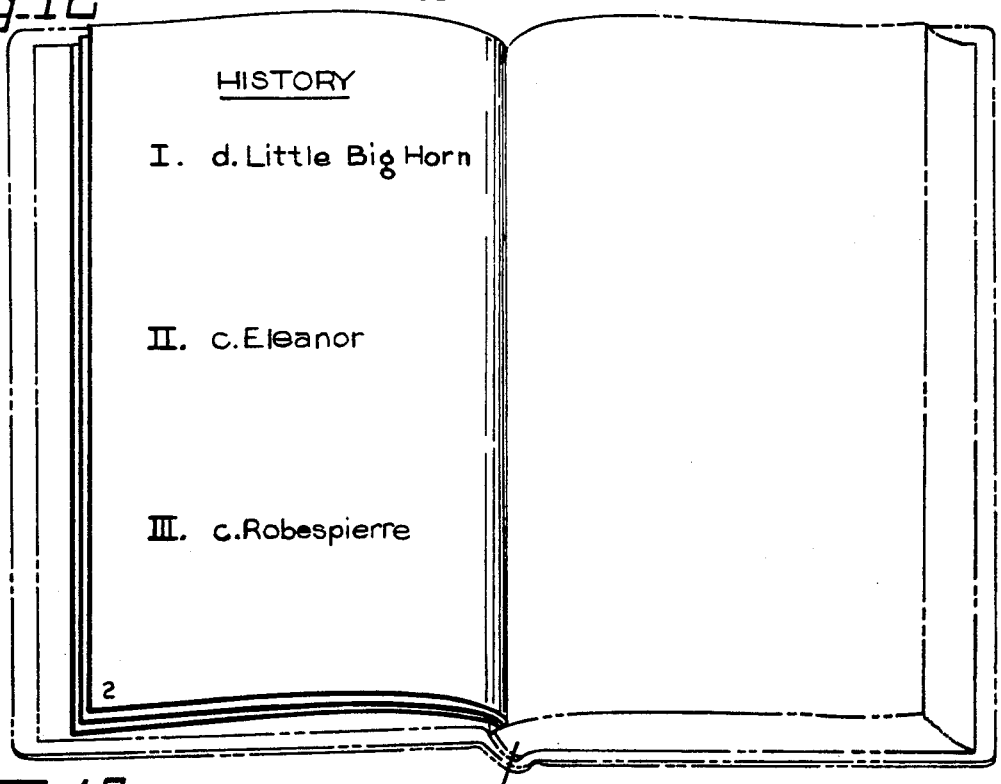
FIG. 13 is a top plan view of the analogy book open to Page 2 and which contains responses to the analogies illustrated on Page 1 of the analogy book first shown in FIG. 12.

Referring to FIGS. 12 and 13, there is illustrated the first and second pages, respectively, for the book 52 pertaining to the history subject major. FIG. 12 illustrates the first page with the three levels of analogies arranged thereon, and FIG. 13 illustrates the reverse page, with the responses to the respective analogies thereon. The Level I analogy for the history book 52 gives the analogous pair "Bonaparte:Waterloo" and, underneath, the word "Custer:" is given. The given analogy in Level I relates a general to a battle, so the correct response is "d. Little Big Horn". Level II gives the analogy "Garibaldi:Anita", which relates a 19th century statesman to his wife. Underneath, the word "Henry II:" is given and the correct analogy response is "c. Eleanor". Henry II was the 12th century king of England and Eleanor was his wife. Level III gives the analogy "Jan. 21, 1793: Louis XVI" which relates the date on which the monarch King Louis XVI of France was executed. Beneath that given analogous pair is the date "Jul. 28, 1794:" to which the correct response is "c. Robespierre". This relates the famous leader of the French Revolution of 1789 to the date on which he was executed. It should be noted that FIGS. 10–13 are given as examples of layouts for analogies and responses for the history and health/physical education/reaction books 52. The analogies and responses shown on FIGS. 10–13 do not have to appear on the pages that they do, respectively Page 1 and Page 2; they could be placed anywhere throughout the respective books 52 and other analogies could be found on Page 1 with their respective responses being found on the opposite page which is designated Page 2.

The following tables listed "Table I" through "Table VI" give examples of Level I, Level II, and Level III analogies for the remaining six subject majors for illustrating their arrangement on the pages of their respective books 52:

TABLE I

| Geography-Green |
|---|
| I. Quarantine:Epidemic |
| Levee: |
| a. drought |
| b. flood |
| c. rain |
| d. invasion |
| Answer: I. b. flood |
| II. West Indies:Antilles |
| Outer Hebrides: |
| a. Ireland |
| b. Scotland |
| c. Greenland |
| d. Norway |
| Answer: II. b. Scotland |
| III. Crimea:Russia |
| Estremadura: |
| a. Mexico |
| b. Italy |
| c. Spain |
| d. Austria |
| Answer: III. c. Spain |

TABLE II

| Science-Brown |
|---|
| I. Scales:Fish |
| Quills: |
| a. coat |
| b. wood |
| c. porcupine |
| d. fur |
| Answer: I. c. porcupine |
| II. Dromedary:Camel |
| Pachyderm: |
| a. kingfisher |
| b. ibex |
| c. antelope |
| d. elephant |
| Answer: II. d. elephant |
| III. Farady:Capacitance |
| Mutual Inductance: |
| a. ampere |
| b. Volt |
| c. Henry |
| d. ohm |
| Answer: III. d. ohm |

TABLE III

| Arts & Media-Yellow |
|---|
| I. Pogo:Walt Kelly |
| Charlie Brown: |
| a. Jules Feiffer |
| b. Peter Arno |
| c. H. T. Webster |
| d. Charles Schultz |
| Answer: I. d. Charles Schultz |
| II. Eliot:Poetry |
| Rothko: |
| a. music |
| b. science |
| c. painting |
| d. drama |
| Answer: II. c. painting |
| III. Foulard:Paisley |
| Voile: |
| a. project |
| b. pastiche |
| c. lancet |
| d. tulle |

TABLE III-continued

| Arts & Media-Yellow |
|---|
| Answer: III. d. tulle |

TABLE IV

| English-Purple |
|---|
| I. Bacchus:Wine |
| Eros: |
| a. sea |
| b. sun |
| c. wisdom |
| d. love |
| Answer: I. d. love |
| II. Golden Apple:Aphrodite |
| Golden Fleece: |
| a. Hercules |
| b. Alexander |
| c. Jason |
| d. Theseus |
| Answer: II. c. Jason |
| III. Dante:Beatrice |
| Laura: |
| a. Boccaccio |
| b. Castiglione |
| c. Casanova |
| d. Petrarch |
| Answer: III. d. Petrarch |

TABLE V

| Religion and Philosophy-Blue |
|---|
| I. Eddy:Christian Science |
| Smith: |
| a. meditation |
| b. Mormonism |
| c. existentialism |
| d. Jehovah's Witness |
| Answer: I. b. Mormonism |
| II. George Fox:Quakers |
| Jesuits: |
| a. St. Augustine |
| b. John Bunyan |
| c. Ignatius Loyola |
| d. John Wycliffe |
| Answer: II. c. Ignatius Loyola |
| III. Etymology:Words |
| Hagiology: |
| a. business |
| b. senility |
| c. saints |
| d. evil spirits |
| Answer: III. c. saints |

TABLE VI

| Business & Math-Red |
|---|
| I. Sine:Opposite Leg |
| Adjacent Leg: |
| a. tangent |
| b. ellipse |
| c. secant |
| d. cosine |
| Answer: I. d. cosine |
| II. Isoceles:Equal Sides |
| Googol: |
| a. equal angles |
| b. parallel sides |
| c. very small number |
| d. very large number |
| Answer: II. d. very large number |
| III. 170:13 |
| 12: |
| a. 100 |
| b. 160 |
| c. 145 |
| d. 190 |

TABLE VI-continued

| Business & Math-Red |
| --- |
| Answer: III. c. 145 |

Referring to FIGS. 1-12, the rules and manner of play of the game 10 will now be described.

First, the board 12 is removed from its storage in the pouch 49 and unfolded for disposition on a level surface, such as a kitchen table or living room floor. The other playing pieces can then be removed from the case 48. The structures 32 are placed on the board 12 within their respective walkways 20, the stage 36 is placed in the center of the walkway 14, and the eight sets of passcards 34 can be either disposed adjacent to their corresponding walkways 20 or left in their compartments within the case 48, and as each player or team of players successfully completes each respective walkway 20, one passcard 34 from the corresponding set is collected by the player(s). Before game play can commence, the graduation requirements must be determined. One player, who may be designated in advance, will randomly select one card from each set of the roll-cards 44 and 46, after which they are placed face up in the holder 42. The holder 42 is then closed and placed on the board 12 and within the walkway 14. Then the stage 36 is placed on top of the closed holder 42.

Next, each player rolls the die 28 in order to pick a subject major and a starting position on the board 12 in front of the corresponding walkway 20. The player that has rolled the highest number chooses first and then, in descending order, the remaining players choose from the remaining subject majors. The player to choose first would generally choose the subject major in which he or she is most knowledgeable. As each respective player or team of players chooses a subject major, they receive the corresponding token 26, and then each token 26 is placed on the corresponding space 24. Play actually commences by each token 26 starting its initial movement from its space 24 in either a clockwise or counterclockwise direction around the chosen walkway 20. Once the player begins moving his token 26 around each walkway 20, movement must continue in the same direction and cannot reverse and move in the opposite direction. The last player to choose his subject major goes first, followed by the second to the last player to choose his subject major, and then in ascending order so that the player that first chose a subject major will go last in actual game playing order.

Playing of the game can now begin by each player rolling the dice 28 and 30 in the order described in the above paragraph. Each player must move around each walkway 20 during the course of the game play; thus, no player can avoid a subject major in which he or she would have difficulty or insufficient knowledge thereof. As shown in FIG. 1, each walkway 20 has distinctive indicia marked on several of the spaces 22 that comprise each walkway 20. "C" denotes course, "AP" denotes academic probation, and "III" denotes a Level III analogy question which must be answered when any player lands on that particular space 22 while moving around that walkway 20. When any player lands on a space 22 having "AP" marked thereon, that player is considered on academic probation and two things occur: (1) the player loses his turn; and (2) in order to continue play the player must correctly respond to a Level II analogy, although no movement is permitted for a correct response. Instead, the player must wait until his next turn in order to continue moving around the walkway 20. If any player should land on the space 22 on which a "III" is marked, then that player must attempt a Level III analogy for that particular subject major corresponding to the walkway 20 within which the player is located. A correct response to the Level III analogy will allow the player to move ahead three spaces. An incorrect response marks the end of the player's turn but on the next turn the player may roll the dice 28 and 30 and continue normal play.

With all the tokens 26 placed on the respective spaces 24, play commences in the order hereinbefore described, with the last player to choose his subject major going first. The player rolls the dice 28 and 30 and moves his token 26 the number indicated on the dice 28, in either a clockwise or counterclockwise direction on spaces 22 of his chosen walkway 20. Each time the player rolls the dice 28 and 30, he must correctly respond to an analogy from the level shown on the die 30. After the player moves the number of spaces 22 indicated by the die 28, he attempts to correctly respond to a particular analogy chosen at random from the book 52 corresponding to his subject major and which corresponds to the level indicated on the die 30. An incorrect response means the player cannot move ahead and his turn is at an end. The player then passes the dice 28 and 30 to the player that was next to last in choosing one of the eight subject majors. However, if the player correctly responds to the particular analogy from the level indicated on the die 30, then he can move the number of spaces corresponding to the level of the analogy plus the number on the die 28. A correct response entitles the player to roll again.

For example, if a player starting out at the space 24 of his chosen walkway 20 rolled a "6" from the die 28 and a "III" from the die 30, and he correctly responded to the Level III analogy from the respective book 52, the player would be entitled to roll again. If that player again rolled a "6" on the die 28 and a Level III on the die 30, and he correctly responded to that analogy level, he would be substantially around the walkway 20 in which he commenced play. The manner of play of the game 10 is thus not determinative on how many analogies to which the players must respond but on correctly responding to each analogy and quickly proceeding around each walkway 20 and collecting one pass card 34 from each subject major. The game 10 combines both luck in rolling high numbers on the die 28 as well as skill in responding to analogies from all three levels of all the subject majors. This also avoids having players bogging down in walkways 20 corresponding to subject majors in which the player(s) may not have knowledge or may have difficulty in giving correct responses pertaining to that respective subject major.

After each player has successfully traversed the walkway 20 in which he commenced game play, he collects one passcard 34 from the set corresponding to that walkway 20. The players do not have to roll the dice 28 and 30 so as to land on the space 24 from which they commenced movement around the respective walkway 20; as long as they collect one corresponding passcard 34 upon exiting that walkway 20, they can move to another walkway 20. Movement on the walkway 14 is in any direction and the players can first proceed to other walkways 20 in which they are knowledgeable or can proceed to walkways 20 in which they are not as well versed but feel they must get out of the way before proceeding to walkways 20 denoting subject majors for which they have more knowledge and, thus, would be more likely to successfully respond to the analogies pertaining thereof. By collecting one passcard 34 for successfully completing each walkway 20, the players can keep track of which walkways 20 they have entered and successfully traversed, and which walkways 20 they still must complete. Each player must successfully complete all eight walkways 20 and should collect one passcard 34 for each walkway 20. More than one player can traverse the walkways 20 at a time and more than one player can land on any space 16, 18, and 22.

After each player has collected one passcard 34 from all eight of the passcard sets, indicating that he has successfully traversed all the walkways 20, then that particular player returns to the space 24 of the walkway 20 from which he commenced play of the game 10. The player must take a final exam in order to proceed further in the play of the game 10; the final exam consists of correctly responding to one Level III analogy from the book 52 corresponding to the subject major of the first walkway 20 in which the player started and successfully completed. If a player gives an incorrect response to the Level III analogy, the player remains on the space 24 until the next turn when the player can attempt to correctly respond to another Level III analogy from the same book 52. A correct response will make that particular player eligible for graduation. Play of the game could proceed in a manner so that players are returning one after another to the space 24 from which they commenced play and each player in turn could be attempting to correctly respond to the Level III analogy for their final exam. Each player must remember which walkway 20 was their original starting point for playing the game 10. However, the players must roll the die 28 in order to return their token 26 to the space 24 from which they commenced play. They are not simply allowed to move their token 26 to that space 24 after they have successfully traversed the last walkway 20.

The first player to pass the final exam for his subject major will move his token 26 to the space 40 located on the stage 36. In addition, the player will remove the holder 42 from beneath the stage 36, thus revealing the preselected rollcards 44 and 46. The rollcards 44 and 46 determine the graduation requirements, i.e., the requirements for rolling the dice 28 and 30 to graduate and win the game. For example, the first player to pass the final exam and move his or her token 26 to the space 40 will open the holder 42 revealing the rollcards 44 and 46. They may be, for example, the rollcard 44 from the first set having the "I" marked thereon and the rollcard 46 from the second set having a single dot, denoting the "1". Given this example, the correct roll of the dice 28 and 30 would be snake eyes—rolling the die 30 to come up with the number "I" and the die 28 to come up with the "1". As each player passes their final exam for the subject major from which they commenced play, they move their token 26 to the space 40. As play comes around to the player that first passed the final exam and placed his or her token 26 on the stage 36, that player attempts to roll the dice 28 and 30, in keeping with the above example, to get a Level I on the die 30 and a "1" represented by the single dot on the die 28. The stage 36 may quickly fill up as players pass their final exam and then start rolling for the preselected combination on the rollcards 44 and 46 revealed when opening the holder 42. If any player rolls the correct number corresponding to one or the other of the rollcards 44 or 46, then that player moves his or her token 26 to the respective space 38 denoting either the analogy level on the die 30 or the number corresponding to the number on the die 28. It may turn out that several players are on the same space 38 waiting to roll the dice 28 and 30 for either the correct number or analogy level. The first player to roll the correct combination denoted on the two rollcards 44 and 46 is declared the winner. Once the players have reached the stage 36 after passing their final exam, it is merely a matter of rolling the right combination on the dice 28 and 30 as the game rules do not require responding to any analogies from any of the books 52 at this final stage of play.

Since it is obvious that many additional changes and modifications can be made in the above-described details without departing from the nature and spirit of the invention, it is understood that the invention is not to be limited to said details except as set forth in the appended claims.

We claim:

1. An educational and entertainment board game apparatus, comprising:

a game board adapted for disposition on a flat surface and having a centrally located continuous main walkway arranged thereon, the main walkway characterized by a plurality of continuously connected main walkway spaces, a plurality of subject major walkways arranged about the main walkway of the game board with each subject major walkway including a plurality of continuously connected subject spaces, and a plurality of connecting squares arranged on the game board for connecting the subject major walkways to the main walkway;

a plurality of subject majors with each respective subject major representing a general field of knowledge and denoted by one particular subject major walkway;

a plurality of colored playing tokens disposed for movement in any direction on the main walkway, the subject major walkways and the connecting spaces, with each playing token representing at least one player;

a plurality of analogy books with each analogy book containing a plurality of questions and answer in the form of analogies and responses pertaining to one respective subject major;

each analogy book further characterized by having the analogies and responses arranged on a plurality of levels of difficulty;

a plurality of pass card sets with the cards of each set having indicia marked thereon denoting one respective subject major and each pass card set corresponding in color with one of the playing tokens and one of the analogy books;

one pass card from each pass card set being given to each player after that player has successfully completed one subject major walkway;

incremental movement means for determining the range of movement of each playing token on the game board and for determining the particular level of analogy question to be answered; and a graduation stage including a plurality of graduation spaces arranged thereon, with each graduation space having unique indicia marked thereon corresponding to either the levels of questions and answers of each analogy book or the range of movement defined by the incremental movement means.

2. The board game apparatus of claim 1 further comprising a portable carrying case for storage of all the above-named elements.

3. The board game apparatus of claim 1 wherein the incremental movement means includes at least one six-sided numbered die.

4. The board game apparatus of claim 1 wherein the incremental movement means includes at least one analogy level die having indicia marked thereon corresponding to each analogy level in each analogy book.

5. The board game apparatus of claim 1 wherein the analogies and responses contained in each analogy book are divided into three levels, respectively Level I, Level II, and Level III.

6. The board game apparatus of claim 1 wherein the number of subject majors is eight.

7. The board game apparatus of claim 6 wherein the number of analogy books utilized is eight.

8. The board game apparatus of claim 7 wherein eight sets of pass cards are utilized with the subject major of each set of pass cards denoted by indicia marked thereon and which corresponds to one of the eight subject majors.

9. The board game apparatus of claim 1 further comprising a first set of graduation roll cards having indicia marked thereon denoting each level of the analogies contained in the analogy books.

10. The board game apparatus of claim 9 further comprising a second set of graduation roll cards having indicia marked thereon corresponding to the range of numbers marked on the six-sided die.

11. The board game apparatus of claim 10 further comprising a graduation roll card holder for containing therein the first set and the second set of graduation roll cards.

12. The board game apparatus of claim 11 wherein one graduation roll card from the first set and one graduation roll card from the second set is pre-selected before play begins and placed face up in the graduation roll card holder.

13. The board game apparatus of claim 1 further comprising a plurality of building structures for disposition on the game board, each building structure having a unique shape for denoting one particular subject major and placed within the corresponding subject major walkway on the game board.

* * * * *